US006870330B2

(12) United States Patent
Choi

(10) Patent No.: US 6,870,330 B2
(45) Date of Patent: Mar. 22, 2005

(54) SHORTED LAMP DETECTION IN BACKLIGHT SYSTEM

(75) Inventor: Hwangsoo Choi, Fullerton, CA (US)

(73) Assignee: Microsemi Corporation, Irvine, CA (US)

( * ) Notice: Subject to any disclaimer, the term of this patent is extended or adjusted under 35 U.S.C. 154(b) by 35 days.

(21) Appl. No.: 10/400,326

(22) Filed: Mar. 26, 2003

(65) Prior Publication Data

US 2004/0189216 A1 Sep. 30, 2004

(51) Int. Cl.[7] ..... G05F 1/00
(52) U.S. Cl. ..... 315/307; 315/291; 315/224
(58) Field of Search ..... 315/307, 291, 315/297, 274, 276, 279, 282, 224, 219

(56) References Cited

U.S. PATENT DOCUMENTS

| | | | | |
|---|---|---|---|---|
| 4,745,339 A | | 5/1988 | Izawa et al. | |
| 5,420,779 A | | 5/1995 | Payne | |
| 5,485,059 A | * | 1/1996 | Yamashita et al. | 315/307 |
| 5,629,588 A | | 5/1997 | Oda et al. | |
| 5,635,799 A | | 6/1997 | Hesterman | |
| 5,663,613 A | | 9/1997 | Yamashita et al. | |
| 5,710,489 A | | 1/1998 | Nilssen | |
| 5,751,115 A | | 5/1998 | Jayaraman et al. | |
| 5,751,120 A | | 5/1998 | Zeitler et al. | |
| 5,777,439 A | | 7/1998 | Hua | |
| 5,808,422 A | | 9/1998 | Venkitasubrahmanian et al. | |
| 5,883,473 A | | 3/1999 | Li et al. | |
| 5,910,709 A | | 6/1999 | Stevanovic et al. | |
| 5,930,126 A | | 7/1999 | Griffin et al. | |
| 6,211,625 B1 | | 4/2001 | Nilssen | |
| 6,259,615 B1 | | 7/2001 | Lin | |
| 6,331,755 B1 | | 12/2001 | Ribarich et al. | |
| 6,340,870 B1 | | 1/2002 | Yamashita et al. | |
| 6,710,555 B1 | * | 3/2004 | Terada et al. | 315/291 |
| 2004/0051473 A1 | * | 3/2004 | Jales et al. | 315/276 |

* cited by examiner

*Primary Examiner*—Tuyet Thi Vo
(74) *Attorney, Agent, or Firm*—Knobbe, Martens, Olson & Bear, LLP.

(57) ABSTRACT

A power conversion circuit senses an output voltage to detect shorted lamp conditions in a backlight system. The power conversion circuit can drive at least one fluorescent lamp. A voltage sensing feedback circuit, such as a capacitive voltage divider or a resistive voltage divider, senses the output voltage at an output of the power conversion circuit and generates a voltage feedback signal for a shorted lamp detector. The shorted lamp detector reliably detects a shorted lamp condition of one fluorescent lamp in a multi-lamp configuration or detects a short circuit condition of the output voltage line coupling the output voltage of the power conversion circuit to the fluorescent lamps.

13 Claims, 8 Drawing Sheets

SHORTED LAMP DETECTION IN BACKLIGHT SYSTEM

BACKGROUND OF THE INVENTION

1. Field of the Invention

The present invention relates to a power conversion circuit for driving fluorescent lamps in a backlight system, and more particularly relates to a lamp inverter for improved detection of a shorted lamp condition in the backlight system.

2. Description of the Related Art

Fluorescent lamps are used in a number of applications where light is required but the power required to generate the light is limited. One particular type of fluorescent lamp is a cold cathode fluorescent lamp (CCFL). CCFLs are used for back lighting or edge lighting of liquid crystal displays (LCDs). LCDs are typically used in notebook computers, web browsers, automotive and industrial instrumentations, and entertainment systems. Each LCD typically uses multiple CCFLs.

CCFL tubes typically contain a gas, such as argon, xenon, or the like, along with a small amount of mercury. After an initial ignition stage and the formation of plasma, current flows through the tube. The current causes the generation of ultraviolet light. The ultraviolet light strikes a phosphorescent material that coats the inner wall of the tube to cause the phosphorescent material to emit visible light.

A power conversion circuit (e.g., an inverter) is generally used for driving one or more CCFLs. The power conversion circuit accepts a direct current (DC) input voltage and provides an alternating current (AC) output voltage to the CCFLs. The brightness (or the light intensity) of the CCFLs is controlled by controlling the current (i.e., the lamp current) through the CCFLs. For example, the CCFLs can be dimmed or brightened by decreasing or increasing the average lamp current.

CCFLs are susceptible to defects or damage, which can cause short circuit conditions that may damage the power conversion circuit. The power conversion circuit is typically difficult and expensive to replace after installation. Thus, shorted lamp protection is generally provided to protect the power conversion circuit during a shorted lamp condition. The impedance of an operable CCFL is typically between 80 kilohms and 100 kilohms. The shorted lamp condition occurs when the impedance across the CCFL is significantly lower (e.g., less than 2 kilohms). This shorted lamp condition is typically detected by sensing the lamp current. For example, a sensing transformer or a sensing resistor can be coupled in series with the CCFLs to sense the lamp current and to provide a feedback signal to the power conversion circuit. The power conversion circuit may shut down when the average lamp current becomes excessive, which indicates a shorted lamp condition.

One problem with sensing the lamp current to detect the shorted lamp condition is that some shorted lamp conditions may not be reliably detected, especially when the power conversion circuit drives multiple CCFLs. For example, the lamp current may only increase 20%–30% when one CCFL is shorted in a multiple CCFL configuration. The 20%–30% increase may be within the range of operating lamp currents for increasing the intensity of the CCFLs and may not trigger the shorted lamp protection. Furthermore, the sensing transformer used in some applications has a current limit which can impede the detection of the shorted lamp condition. In addition, lamp current sensing does not sense a short circuit condition at the output of the power conversion circuit, which can be caused by improper installation of the power conversion circuit or the CCFLs.

SUMMARY OF THE INVENTION

One aspect of embodiments in accordance with the present invention is a backlight system that senses an output voltage (or a lamp voltage) to detect a shorted lamp condition. The backlight system senses a decrease in the output voltage resulting from the shorted lamp condition. The backlight system reliably detects a short circuit condition of one lamp in a multi-lamp parallel configuration.

In one embodiment, the power conversion circuit includes a controller, a primary network, a secondary network, a voltage sensing feedback circuit, and a shorted lamp detector. Input power is provided to the controller and to the primary network. The controller provides driving signals to the primary network. The secondary network is coupled to the primary network and produces the output voltage to drive the CCFL. The voltage sensing feedback circuit is coupled to the secondary network to sense the output voltage and to generate a voltage feedback signal for the shorted lamp detector. The shorted lamp detector outputs a disable signal to the controller to shut down the power conversion circuit when the shorted lamp condition is detected.

In one embodiment, the voltage sensing feedback circuit uses a voltage divider (e.g., a capacitive voltage divider or a resistive voltage divider) to generate the voltage feedback signal. During normal operations, the output voltage is an AC signal with a typical lamp voltage amplitude (e.g., a root-mean-square (rms) value in the range of 1–2 kilovolts) and a typical lamp operating frequency (e.g., 30–100 kilohertz). The voltage divider reduces the amplitude of the output voltage proportionately to a detectable level. For example, the element values of the voltage divider can be chosen such that the amplitude of the voltage feedback signal is one-thousandth of the amplitude of the output voltage. Thus, the rms amplitude of the voltage feedback signal is approximately one-thousandth of the output voltage (e.g., in the range of 1–2 volts) during normal operations. During the shorted lamp condition, the amplitude of the output voltage is relatively low or close to zero. Correspondingly, the amplitude of the voltage feedback signal is close to zero during the shorted lamp condition.

In one embodiment, the shorted lamp detector includes a high voltage detector, a conditioning circuit, and a threshold detector. The voltage feedback signal is provided to the high voltage detector. The high voltage detector outputs periodic pulses during normal operations. For example, the voltage feedback signal is an AC signal with sufficient amplitude (e.g., greater than 0.7 volts) to cause the high voltage detector to generate periodic pulses of the same frequency and fixed amplitude during normal operations. During the shorted lamp condition, the amplitude of the voltage feedback signal is close to zero and is insufficient to cause the high voltage detector to generate periodic pulses. Thus, the high voltage detector outputs substantially zero volt during the shorted lamp condition.

The output of the high voltage detector is coupled to the conditioning circuit. The conditioning circuit outputs a substantially DC voltage of a first level when periodic pulses are present at the high voltage detector output. The output of the conditioning circuit transitions to a substantially DC voltage of a second level when the periodic pulses stop.

The output of the conditioning circuit is coupled to the threshold detector. The threshold detector compares the output of the conditioning circuit with a predefined reference voltage to detect shorted lamp conditions. The threshold circuit outputs a signal to disable the power conversion circuit when a shorted lamp condition is detected. In one embodiment, the output of the threshold detector is coupled to the controller of the power conversion circuit.

In one embodiment, an intermittent shorted lamp condition does not affect the operation of the power conversion circuit. The power conversion circuit may not be harmed by intermittent shorted lamp conditions that last less than a predetermined duration (e.g., one second). Thus, the power conversion circuit is not disabled as a result of the intermittent shorted lamp condition.

During the intermittent shorted lamp condition, the periodic pulses at the output of the high voltage detector are absent for less than the predetermined duration. The rate at which the output voltage of the conditioning circuit transitions from the first level to the second level is controlled so that the absence of periodic pulses for less than the predetermined duration does not trigger the threshold detector to output a disable signal.

DETAILED DESCRIPTION OF THE PREFERRED EMBODIMENTS

Preferred embodiments in accordance with aspects of the present invention will be described hereinafter with reference to the drawings.

Figure 1:
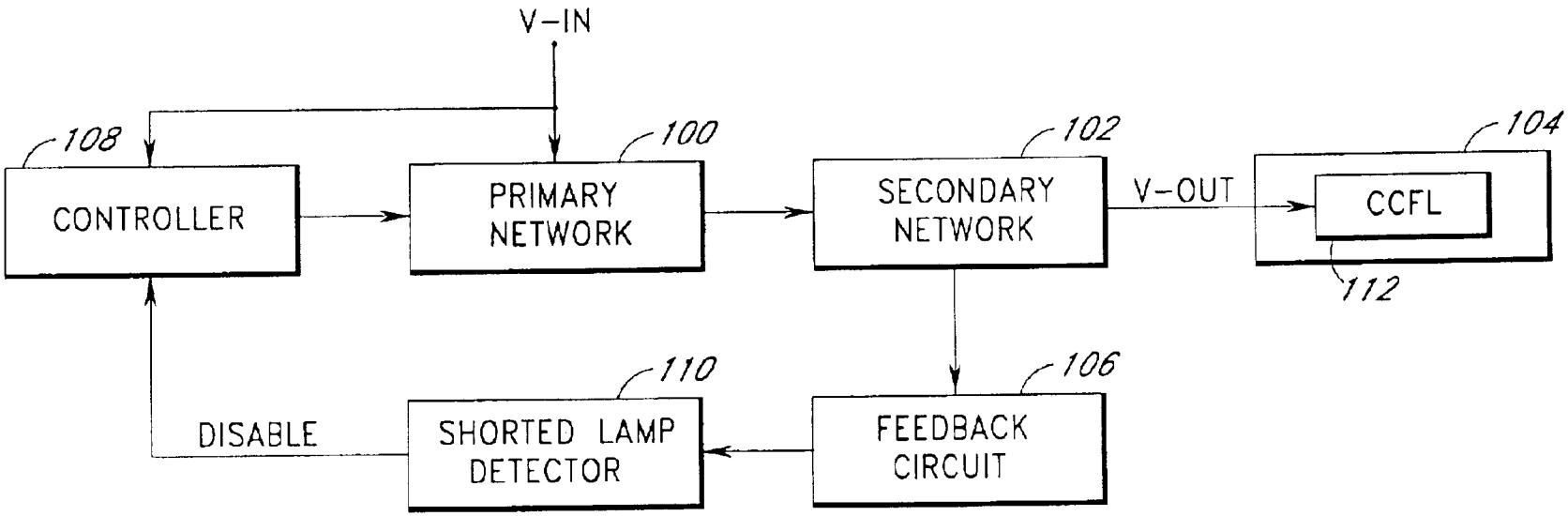
FIG. 1 is a block diagram of a power conversion circuit according to one embodiment of the present invention.

FIG. 1 is a block diagram of a power conversion circuit according to one embodiment of the present invention. The power conversion circuit (or the lamp inverter) converts a substantially DC input voltage (V-IN) into an AC output voltage (V-OUT) to drive a CCFL 112 in a backlight system. An AC current (or a lamp current) flows through the CCFL 112 to provide illumination in an electronic device 104, such as, for example, a flat panel display, a personal digital assistant, a palm top computer, a scanner, a facsimile machine, a copier, or the like.

The power conversion circuit includes a controller 108, a primary network 100, a secondary network 102, a voltage sensing feedback circuit 106 and a shorted lamp detector 110. The input voltage is provided to the controller 108 and to the primary network 100. The primary network 100 is controlled by driving signals provided by the controller 108. The secondary network 102 is coupled to the primary network 100 and produces the output voltage (or the lamp voltage) to drive the CCFL 112. The voltage sensing feedback circuit 106 is coupled to the secondary network 102 and generates a voltage feedback signal indicative of the lamp voltage for the shorted lamp detector 110. The shorted lamp detector 110 outputs a disable signal (DISABLE) to the controller 108 when a shorted lamp condition is detected.

The output voltage is an AC signal with an effective (e.g., rms) typical lamp voltage amplitude (e.g., in the range of 1–2 kilovolts) during normal operations. When a shorted lamp condition occurs, the level of the output voltage is significantly lower (e.g., less than 100 volts rms). The voltage sensing feedback circuit 106 senses the output voltage and provides a voltage feedback signal proportional to the output voltage to the shorted lamp detector 110. The shorted lamp detector 110 outputs the disable signal when the output voltage has been significantly lower than the normal operating level for at least a predetermined duration indicating a non-intermittent shorted lamp condition.

Figure 2:
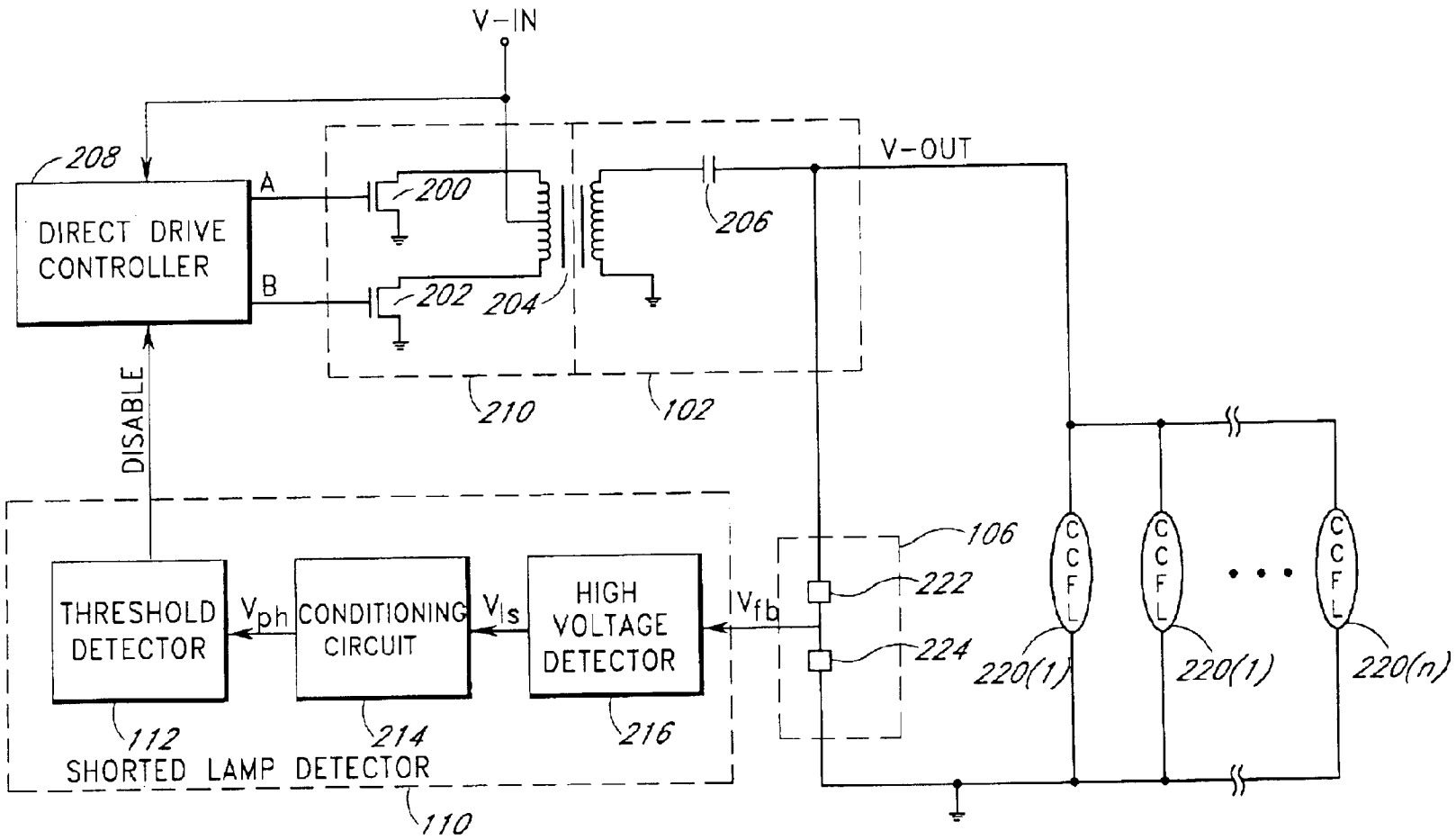
FIG. 2 is a schematic diagram of one embodiment of the power conversion circuit shown in FIG. 1.

FIG. 2 is a schematic diagram of one embodiment of the power conversion circuit shown in FIG. 1. The power conversion circuit includes a direct drive controller 208 and a direct drive primary network 210. Other types of controllers and primary networks are possible. The direct drive controller 208 and the direct drive primary network 210 are provided as examples. The direct drive primary network 210 is controlled by two driving signals (A and B) provided by the direct drive controller 208 and works with the secondary network 102 to provide the output voltage (V-OUT) to one or more parallel connected CCFLs shown as CCFLs 220(1)–220(n) (collectively referred to as the CCFLs 220). The voltage sensing feedback circuit 106 is coupled to the output of the secondary network 102 and in parallel with the CCFLs 220. The output of the voltage sensing feedback circuit 106 is provided to the shorted lamp detector 110, which outputs a disable signal (DISABLE) to the direct drive controller 208 when a shorted lamp condition is detected.

In one embodiment, the direct drive primary network 210 includes a first switching transistor 200, a second switching transistor 202, and a primary winding of a transformer 204. The input voltage is provided to a center-tap of the primary winding of the transformer 204. The switching transistors 200, 202 are coupled to respective opposite terminals of the primary winding of the transformer 204 to alternately switch the respective terminals to ground. For example, the first switching transistor 200 is an n-type field-effect transistor (N-FET) with a drain terminal coupled to a first terminal of the primary winding of the transformer 204 and with a source terminal coupled to ground. The second switching transistor 202 is an N-FET with a drain terminal coupled to a second terminal of the primary winding of the transformer 204 and with a source terminal coupled to ground. The switching transistors 200, 202 are controlled by the respective driving signals (A, B), which are coupled to gate terminals of the respective switching transistors 200, 202.

An AC signal (or a transformer drive signal) on the primary winding results from alternating conduction by the switching transistors 200, 202. Other configurations to couple the input voltage and switching transistors to the transformer 204 are possible to produce the transformer drive signal. The transformer drive signal is magnetically coupled to a secondary winding of the transformer 206 in the secondary network 102, which also includes a DC blocking capacitor 206. A first terminal of the secondary winding of the transformer 204 is coupled to ground while a second terminal of the secondary winding is coupled to a first terminal of the DC blocking capacitor 206. The second terminal of the DC blocking capacitor 206 is coupled to the output of the secondary network 102, which provides the output voltage (or the lamp voltage) to drive the CCFLs 220.

In one embodiment, the voltage sensing feedback circuit 106 is a voltage divider. The voltage sensing feedback circuit 106 includes dividing elements (e.g., resistors or capacitors) 222, 224. The first dividing element 222 is coupled between the output of the secondary network 102 and a common node. The second dividing 224 is coupled between the common node and ground. The voltage at the common node is the voltage feedback signal (Vfb), which has an amplitude that is proportional to the amplitude of the output voltage.

During normal operations, the output voltage is a relatively high voltage (e.g., thousands of volts) AC signal. The voltage divider of the voltage sensing feedback circuit 106 reduces the amplitude of the output voltage proportionately to a detectable level. For example, the voltage divider is designed with an approximate ratio of 1000:1. In one embodiment, the voltage divider is a capacitive voltage divider with a first capacitor having a capacitor value of approximately 2.0 picofarads and a second capacitor having a capacitor value of approximately 2.2 nanofarads to produce a scaled version of the output voltage. The resulting amplitude of the voltage feedback signal is approximately one-thousandth the amplitude of the output voltage (e.g., several volts) and can be processed by relatively low voltage electronics. During shorted lamp conditions, the amplitude of the output voltage is a less than a hundred volts. Correspondingly, the amplitude of the voltage feedback signal is less than one-hundredth of a volt or close to zero.

In one embodiment, the dividing elements 222, 224 can be discrete components or can be fabricated on a printed circuit board (PCB). The PCB can include other components of the power conversion circuit. In one embodiment, the first dividing element 222 is fabricated on the PCB while the second capacitor 224 is a discrete component.

In one embodiment, the shorted lamp detector 110 includes a high voltage detector 216, a conditioning circuit 214 and a threshold detector 212. The voltage feedback signal is provided to the high voltage detector 216, which outputs periodic pulses when the amplitude of the voltage feedback signal is above a voltage threshold indicating normal operations. The high voltage detector 216 outputs no pulses (or a DC voltage) when the amplitude of the voltage feedback signal is below a voltage threshold indicating a shorted lamp condition.

The output (Vls) of the high voltage detector 216 is provided to the conditioning circuit 214. The conditioning circuit 214 tracks periodic pulses from the high voltage detector 216. The conditioning circuit 214 outputs a substantially DC voltage at a first level with the presence of periodic pulses and transitions to a substantially DC output voltage at a second level with the absence of periodic pulses for more than a predetermined duration. The absence of periodic pulses for less than the predetermined duration indicates an intermittent shorted lamp condition that does not affect operation of the power conversion circuit.

The output voltage (Vph) of the conditioning circuit 214 is provided to the threshold detector 212. The threshold detector 212 compares the output of the conditioning circuit 214 with a predefined reference voltage. The threshold detector 212 outputs a disable signal when the output of the conditioning circuit 214 crosses the predefined reference voltage that indicates a non-intermittent shorted lamp condition. In one embodiment, the threshold detector 212 outputs the disable signal to the direct drive controller 208.

Figure 3:
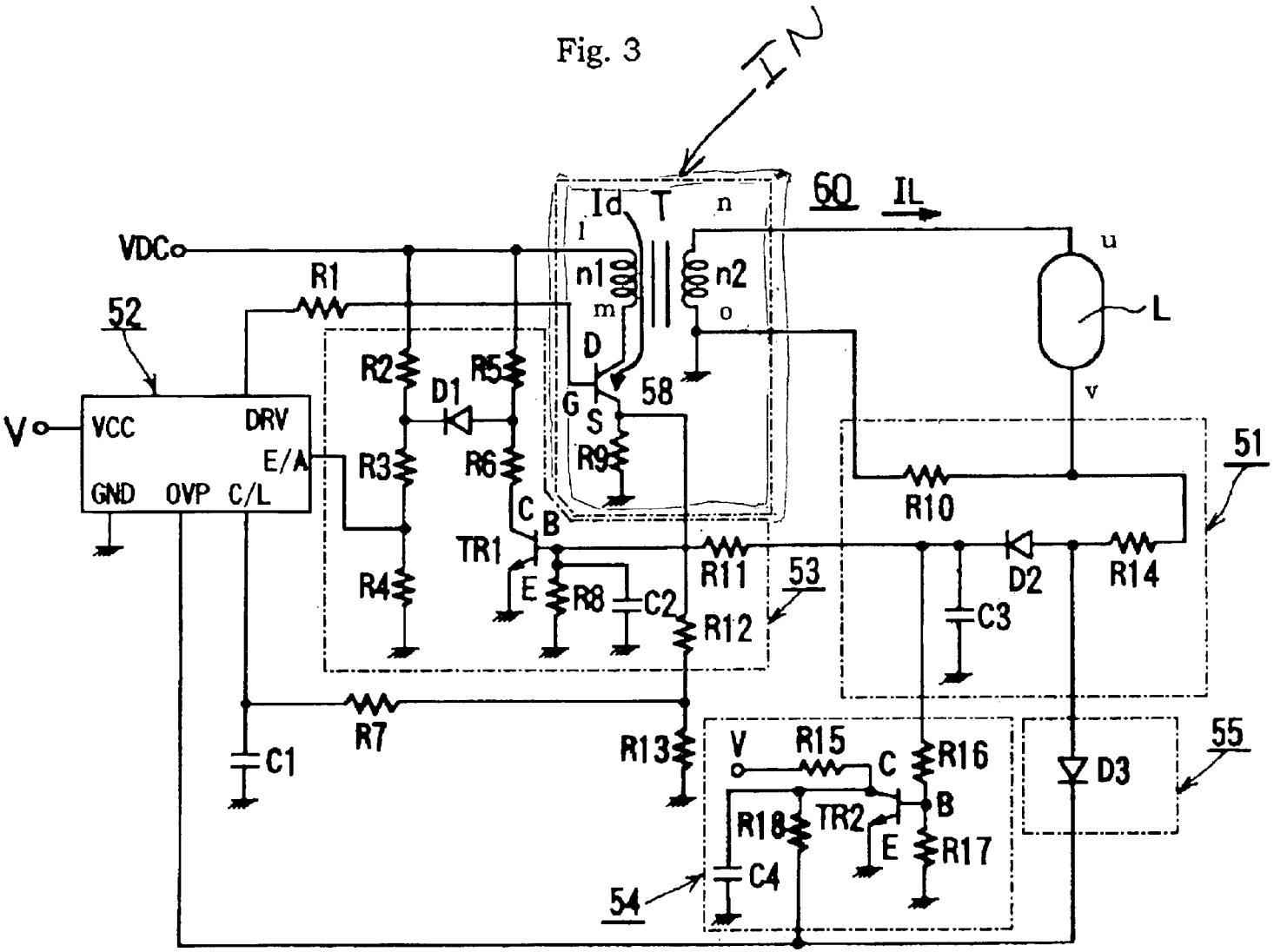
FIG. 3 is a schematic diagram of one embodiment of a shorted lamp detector shown in FIG. 2.

FIG. 3 is a schematic diagram of one embodiment of the shorted lamp detector 110 shown in FIG. 2. The high voltage detector 216 detects a high voltage signal and converts the high voltage signal to pulses. The conditioning circuit 214 conditions the pulses to a DC level with a predetermined time constant. The threshold detector 212 is a comparator circuit. In one embodiment, the high voltage detector 216 is single transistor amplifier that includes an AC coupling capacitor 300, a base resistor 302, a collector resistor 306, and an NPN transistor 304. The AC coupling capacitor 300 couples the voltage feedback signal (Vfb) to a base terminal of the NPN transistor 304. The base resistor 302 is coupled between a power source Vcc (e.g., 5 volts) and the base terminal of the NPN transistor 304. The collector resistor 306 is coupled between the power source Vcc and a collector terminal of the NPN transistor 304. An emitter terminal of the NPN transistor 304 is coupled to ground.

The collector terminal of the NPN transistor 304 provides the output (Vls) of the high voltage detector 216. During normal operations, the voltage feedback signal (Vfb) is an AC signal with sufficient amplitude (e.g., greater than 0.7 volt) to generate periodic pulses at the output (Vls) of the high voltage detector 216. The voltage feedback signal causes the NPN transistor 304 to alternately turn on and turn off during normal operations. When the NPN transistor 304 is on, the collector terminal of the NPN transistor 304 is coupled to ground. When the NPN transistor 304 is off, the voltage at the collector terminal of the NPN transistor 304 rises to the level of the power source (Vcc). Thus, the high voltage detector 216 outputs periodic pulses with voltage levels alternating between ground and Vcc during normal operations.

During shorted lamp conditions, the amplitude of the voltage feedback signal (Vfb) is close to zero. The base resistor 302 sets up the bias of the NPN transistor 304 to be on. Thus, the collector terminal of the NPN transistor 304 is coupled to ground and the high voltage detector 216 outputs a substantially DC signal at approximately zero during shorted lamp conditions.

In one embodiment, the conditioning circuit 214 is a half-wave rectifier with a timing conditioning circuit. The conditioning circuit 214 includes a rectifier diode 308, a timing resistor 310 and a charging capacitor 312. The rectifier diode 308 is coupled between an input terminal and an output terminal of the conditioning circuit 214. An anode of the rectifier diode 308 is coupled to the input terminal, and a cathode of the rectifier diode 308 is coupled to the output terminal. The timing resistor 310 and the charging capacitor 312 are coupled in parallel between the output terminal of the conditioning circuit 214 and ground.

During normal operations, the periodic pulses of the output (Vls) from the high voltage detector 216 pass through the rectifier diode 308 to charge the charging capacitor 312. The conditioning circuit 214 produces an output voltage (Vod) that has a level that is relatively steady and that corresponds to the peak voltage of the periodic pulses of the output (Vls) during normal operations. During shorted lamp conditions, the output (Vls) of the high voltage detector 216 is coupled to ground and has no effect on the rectifier diode 308. The charging capacitor 312 discharges through the timing resistor 310 during shorted lamp conditions, and the output voltage (Vod) of the conditioning circuit 214 decreases to approximately zero at a rate determined by the timing resistor 310.

In one embodiment, the comparator circuit 212 includes a comparator 314. The output (Vod) of the conditioning circuit 214 is provided to an inverting (−) terminal of the comparator 314, and a reference voltage (Vref) is provided to a non-inverting (+) terminal of the comparator 314. The output of the comparator 314 is the output (DISABLE) of the shorted lamp detector 110. During normal operations, the level of the output (Vod) the conditioning circuit 214 is greater than the reference voltage, and the comparator 314 causes the DISABLE output of the shorted lamp detector 110 to be low (i.e., inactive). During shorted lamp conditions, the output level of the conditioning circuit 214 is less than the reference voltage (or approximately zero), and the comparator 314 causes the DISABLE output of the shorted lamp detector 110 to be high (i.e., active) to indicate the detection of a shorted lamp condition. The power conversion circuit may be disabled (or shut down) when the shorted lamp condition is detected. The output (Vod) of the conditioning circuit 214 can be alternately provided to the non-inverting (+) terminal of the comparator 314 with the reference voltage (Vref) provided to the inverting (−) terminal of the comparator 314. Then, the DISABLE output has an opposite logic associated with active or inactive states.

In one embodiment, the rate at which the output voltage of the conditioning circuit 214 transitions from the peak voltage to zero is controlled so that the power conversion circuit is not disabled as a result of intermittent shorted lamp conditions. For example, intermittent shorted lamp conditions may be shorted lamp conditions that last less than a predetermined duration (e.g., one second). The periodic pulses at the output of the high voltage detector 216 are absent for less than the predetermined duration during the intermittent shorted lamp conditions. The output of the conditioning circuit 214 begins to discharge during the absence of the periodic pulses from the output voltage (Vls) of the high voltage detector 216. The value of the timing resistor 310 is chosen to set the discharge rate of the output voltage (Vod) of the conditioning circuit 214 such that the transition from the peak voltage to a level corresponding to the reference voltage of the comparator 314 is approximately equal to or is greater than the predetermined duration corresponding to the intermittent shorted lamp condition. Thus, the comparator 314 is not triggered by the absence of periodic pulses for less than the predetermined duration corresponding to intermittent shorted lamp conditions.

Figure 4:
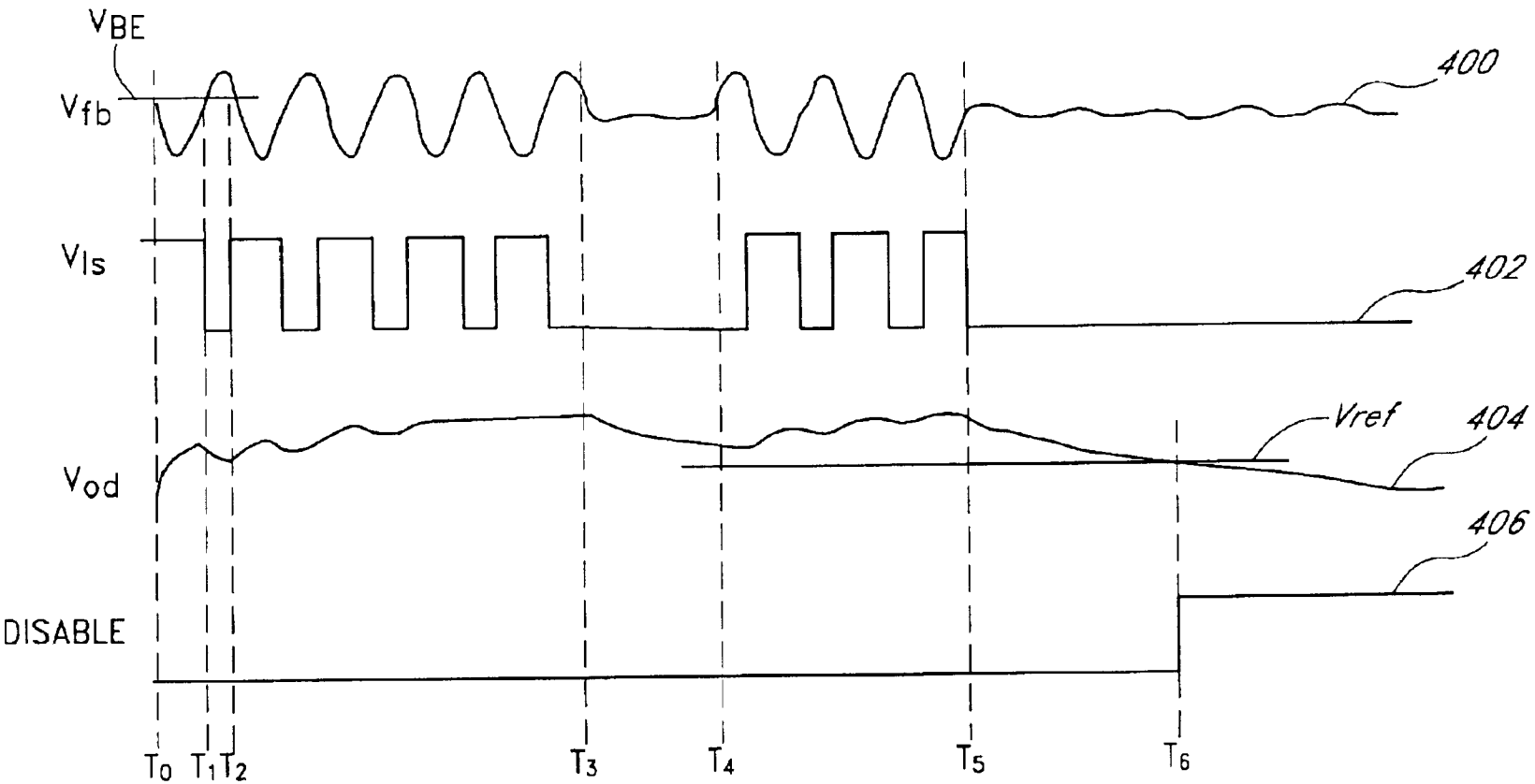
FIG. 4 illustrates timing diagrams that show the waveforms of various signals in the shorted lamp detector of FIG. 3.

FIG. 4 illustrates timing diagrams that show the waveforms of various signals in the shorted lamp detector 110 of FIG. 3. A graph 400 represents the voltage feedback signal (Vfb) provided by the voltage sensing feedback circuit 106 to the shorted lamp detector 110. A graph 402 represents the detected signal voltage (Vls) at the output of the high voltage detector 216. A graph 404 represents the output voltage (Vod) of the conditioning circuit 214. A graph 406 represents the DISABLE output signal of the shorted lamp detector 110.

As illustrated by the graphs 400 and 420, during normal operations, the voltage feedback signal (Vfb) is substantially an AC signal with sufficient amplitude such that the high voltage detector 216 generates periodic pulses in response. For example, normal operations occur during intervals T0–T1, T1–T2, T2–T3 and T4–T5. The high voltage detector 216 outputs periodic pulses during the intervals T0–T1, T1–T2, T2–T3 and T4–T5 with transitions corresponding to transitions of the voltage feedback signal across a voltage threshold (VBE). The output of the high voltage detector 216 is high (e.g., approximately 5 volts) when the voltage feedback signal is lower than the voltage threshold (e.g., during the interval T0–T1). The output of the high voltage detector 216 is low (e.g., approximately zero volt) when the voltage feedback signal is higher than the voltage threshold (e.g., during the interval T1–T2). During shorted lamp conditions, the voltage feedback signal is substantially a DC signal, and the high voltage detector 216 outputs a substantially DC signal (e.g., approximately zero volt) in response. For example, shorted lamp conditions occur during the interval T3–T4 and during the interval T5–T6.

The output voltage of the conditioning circuit 214 follows the periodic pulses from the high voltage detector 216 and maintains a substantially constant level corresponding to the peak voltage of the periodic pulses during normal operations. For example, the output voltage of the conditioning circuit 214 increases with each cycle of the periodic pulses until the peak voltage of the periodic pulses is reached and thereafter holds the peak voltage during intervals T0–T1, T1–T2, T2–T3 and T4–T5. The output voltage of the conditioning circuit 214 decreases to approximately zero at a predetermined rate during shorted lamp conditions. For example, the output voltage of the conditioning circuit 214 decreases during the interval T3–T4 and during the interval T5–T6.

As illustrated by graph 406, the DISABLE output of the shorted lamp detector 110 is low (i.e., inactive) during normal operations (e.g., during the intervals T0–T1, T1–T2, T2–T3 and T4–T5) and intermittent shorted lamp condition (e.g., during the interval T3–T4). The output of the shorted lamp detector 110 is low when the output voltage of the conditioning circuit 214 is greater than the reference voltage (Vref) after the start up of the power conversion circuit.

As shown by the graph 404, during normal operations, the output voltage (Vod) of the conditioning circuit 214 is substantially a DC voltage corresponding to the peak voltage of periodic pulses from the high voltage detector 216 which is greater than the reference voltage (Vref). During intermittent shorted lamp conditions, the output voltage (Vod) of the conditioning circuit 214 decreases. However, the rate of decrease in the output voltage (Vod) is controlled such that the output voltage (Vod) continues to be greater than the reference voltage within a predetermined duration which defines the maximum duration of any intermittent shorted lamp condition.

The DISABLE output of the shorted lamp detector 110 is high (i.e., active) when shorted lamp conditions last longer than the predetermined duration corresponding to the intermittent shorted lamp condition (e.g., after the time T6 at the end of the interval T5–T6). Shorted lamp conditions lasting longer than the predetermined duration (e.g., a condition lasting throughout the interval T5–T6) causes the output (Vod) of the conditioning circuit 214 to fall below the reference voltage, and the shorted lamp detector 110 outputs an active DISABLE signal to indicate the detection of a non-intermittent shorted lamp condition.

Figure 5:
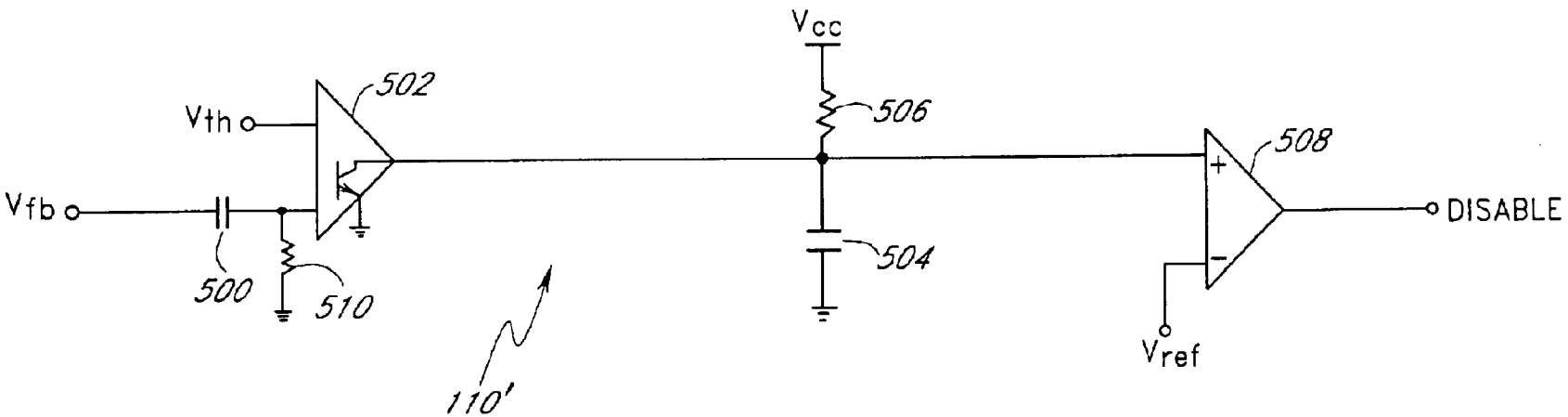
FIG. 5 is a schematic of an alternative embodiment of the shorted lamp detector.

FIG. 5 is a schematic of an alternative embodiment 110' of the shorted lamp detector 110. The shorted lamp detector 110' includes an AC coupling capacitor 500, a signal sensing resistor (R1) 510, an open collector (or an open drain) comparator 502, a holding capacitor 504, a pull-up resistor 506, and a reference comparator 508. The voltage feedback signal (Vfb) from the voltage sensing feedback circuit 106 is provided to the open collector comparator 502 via the series AC coupling capacitor 500 and the signal sensing resistor 510 coupled between an input of the open collector comparator 502 and ground. The open collector comparator 502 compares the voltage feedback signal with a threshold voltage (Vth). An output of the open collector comparator 502 is coupled to a common node. The holding capacitor 504 is coupled between the common node and ground. The pull-up resistor 506 is coupled between the common node and a power source (Vcc). The common node is also coupled to a non-inverting (+) terminal of the reference comparator 508. A reference voltage (Vref) is coupled to an inverting (−) terminal of the reference comparator 508. The reference comparator generates the DISABLE output for the shorted lamp detector 110.

In one embodiment in accordance with FIG. 5, the open collector comparator 502 actively pulls the common node down to a relatively low voltage (e.g., approximately ground) when the voltage feedback signal is above the threshold voltage. The open collector comparator 502 is inactive when the voltage feedback signal is below the threshold voltage, and the pull-up resistor 506 supplies current to increase the voltage on the common node. During normal operations, the voltage feedback signal is a periodic voltage that fluctuates above and below the threshold voltage. Thus, the open collector comparator 502 periodically grounds the common node during normal operations. The periodic grounding of the common node drains any charges stored in the holding capacitor 504, and the common node maintains a relatively low voltage which is less than the reference voltage. As a result, the output of the reference comparator is low (i.e., inactive) to indicate that a shorted lamp condition has not been detected.

During shorted lamp conditions, the voltage feedback signal is less than the threshold voltage, and the open collector comparator 502 is inactive. The power source charges the holding capacitor 504 via the pull-up resistor 506. The common node reaches a voltage that is approximately the level of the power source, which is greater than the reference voltage. As a result, the output of the reference comparator 508 is high (i.e., active) to indicate that a shorted lamp condition has been detected.

Figure 6:
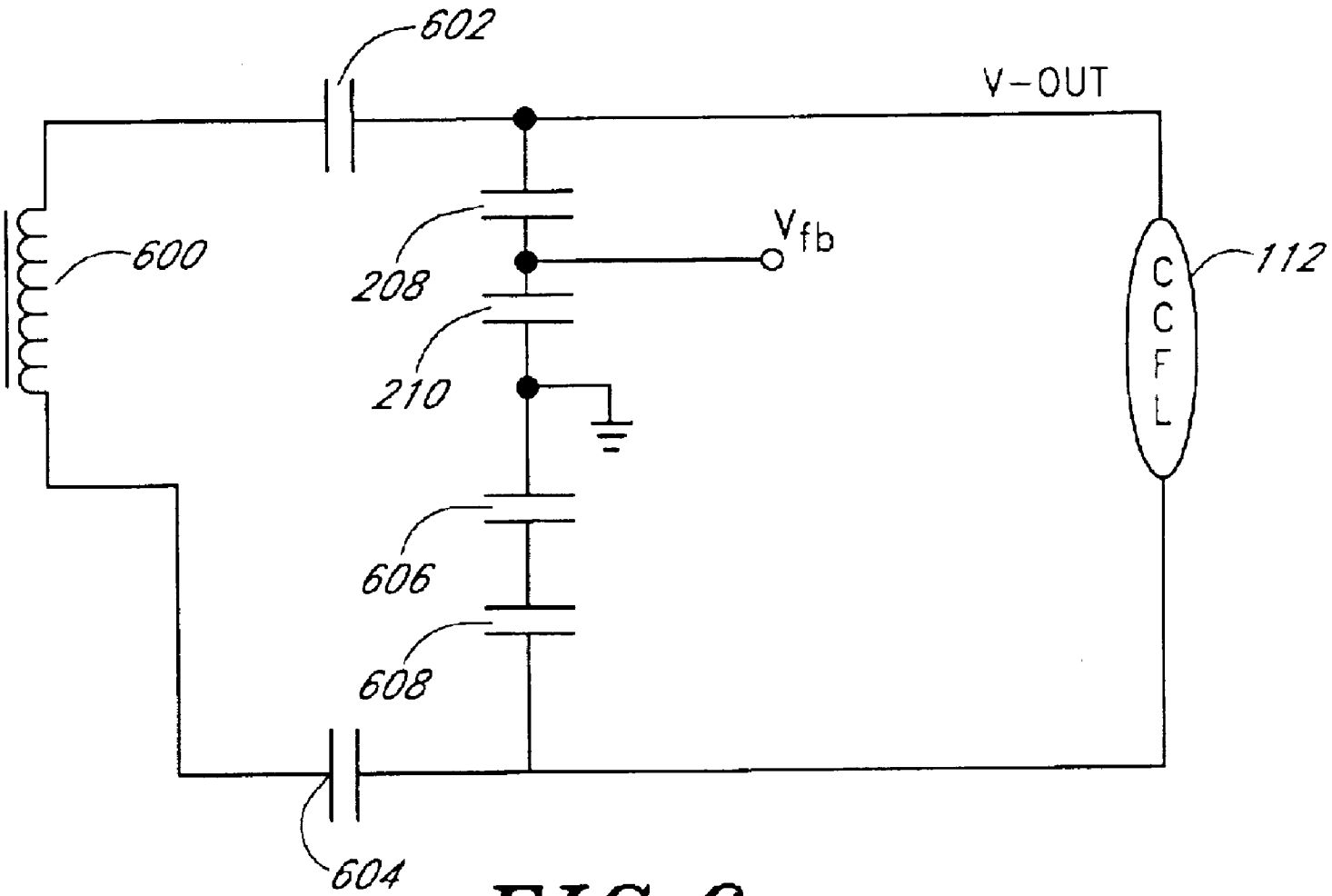
FIG. 6 illustrates an application of the shorted lamp detector in a power conversion circuit with floating outputs.

FIG. 6 illustrates an application of the shorted lamp detector 110 in a power conversion circuit with floating outputs. The power conversion circuit includes DC blocking (or AC coupling) capacitors 602, 604 coupled in series with respective output terminals of a secondary winding 600 of a transformer in a secondary network to generate a floating output voltage (V-OUT) across the CCFL 112. A partial circuit of the power conversion circuit illustrating the secondary network and a voltage sensing feedback circuit is shown for clarity.

The voltage feedback signal (Vfb) for the shorted lamp detector 110 is derived from the voltage sensing feedback circuit which includes two voltage dividers (e.g., two capacitive voltage dividers or two resistive voltage dividers) coupled in series across the floating output voltage (or the lamp voltage). Two capacitive voltage dividers are illustrated as examples. For example, a first capacitor 208 and a second capacitor 210 are coupled in series between a first terminal of the floating output voltage and ground to form a first capacitive voltage divider. A third capacitor 606 and a fourth capacitor 698 are coupled in series between ground and a second terminal of the floating output voltage to form a second capacitive voltage divider., The voltage feedback signal is taken from the common node connecting the first capacitor 208 and the second capacitor 210.

Figure 7:
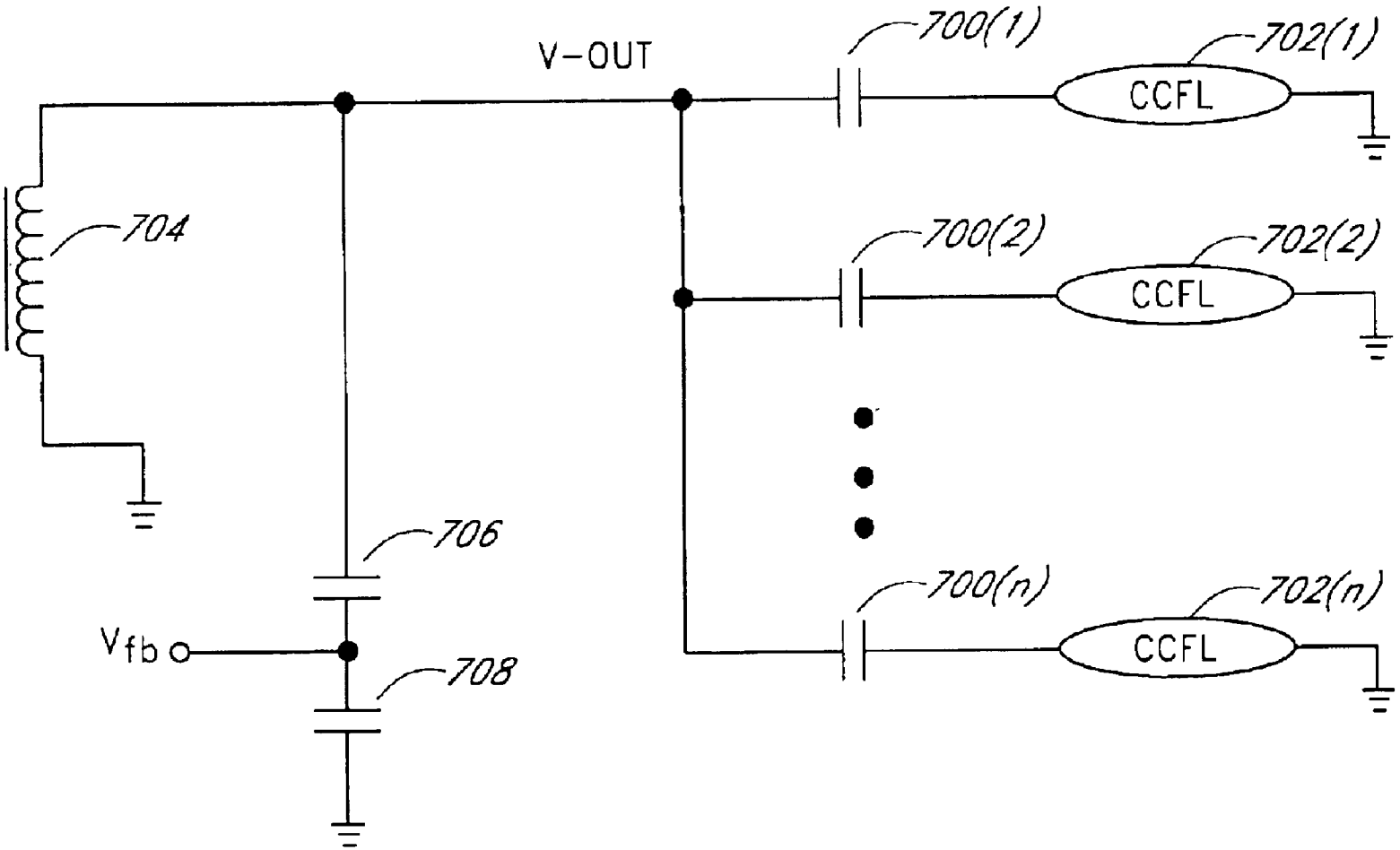
FIG. 7 illustrates an application of the shorted lamp detector in a power conversion circuit for driving multiple fluorescent lamps.

FIG. 7 illustrates a configuration for detecting shorted lamp conditions using a single detection point in a power conversion circuit for driving multiple fluorescent lamps. A secondary winding 704 of a transformer in a secondary network of the power conversion circuit provides an output voltage (V-OUT) to commonly connected input terminals of a plurality of DC blocking capacitors shown as DC blocking capacitors 700(1)–700(n) (collectively referred to as the DC blocking capacitors 700). A plurality of CCFLs shown as CCFLs 702(1)–702(n) (collectively referred to as the CCFLs 702) are coupled between respective output terminals of the DC blocking capacitors 700 and ground. A high voltage divider (e.g., a resistive voltage divider or a capacitive voltage divider) is coupled across the secondary winding 704 to sense the output voltage and to generate a voltage feedback signal (Vfb) for a shorted lamp detector 110. A capacitive voltage divider is illustrated as an example. For example, a first capacitor 706 and a second capacitor 708 are coupled in series between the output voltage and ground. The voltage feedback signal is derived from the common node connecting the first capacitor 706 and the second capacitor 708.

In one embodiment, the power conversion circuit advantageously employs direct drive topology. For example, the power conversion circuit uses a direct drive controller and a direct drive primary network to generate the output voltage across the secondary winding 704 of the transformer in the secondary network. The values of the DC blocking capacitors 700 are relatively large (e.g., 100 picofarads–1,000 picofarads) which allows for the detection of shorted lamp conditions among the plurality of CCFLs 702 using one voltage feedback signal.

Figure 8:
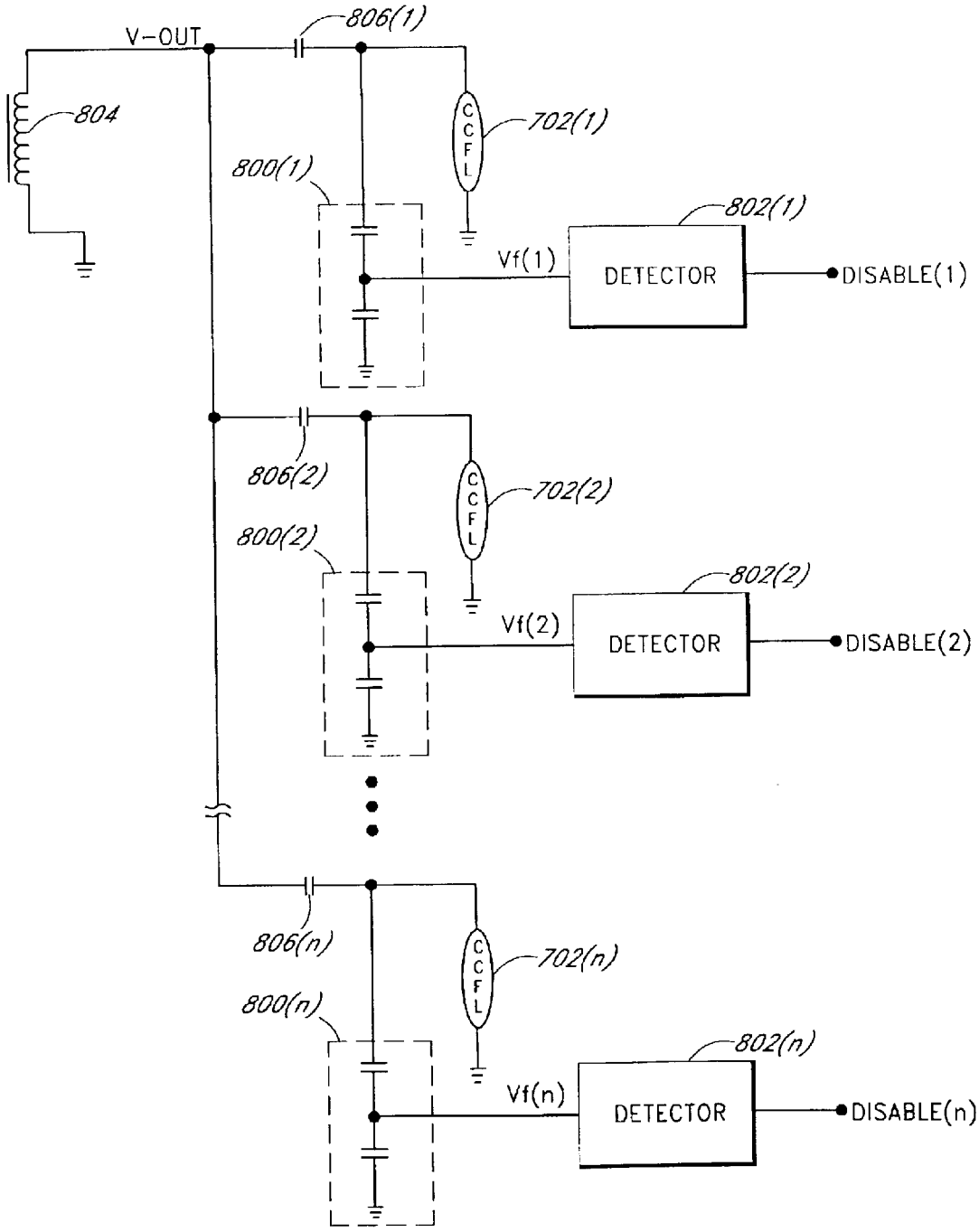
FIG. 8 illustrates an alternative application of the shorted lamp detector in a power conversion circuit for driving multiple fluorescent lamps.

FIG. 8 illustrates an alternate configuration for detecting shorted lamp conditions using multiple detection points in a power conversion circuit for driving multiple fluorescent lamps. A secondary winding 804 of a transformer in a secondary network of the power conversion circuit provides an output voltage (V-OUT) to commonly connected input terminals of a plurality of DC blocking capacitors shown as DC blocking capacitors 806(1)–806(n) (collectively referred to as the DC blocking capacitors 806). A plurality of CCFLs shown as CCFLs 702(1)–702(n) (collectively referred to as the CCFLs 702) are coupled between respective output terminals of the DC blocking capacitors 806 and ground. A plurality of voltage dividers shown as voltage dividers 800(1)–800(n) (collectively referred to as the voltage dividers 800) are coupled in parallel with the respective CCFLs 702 to sense the voltages across the respective CCFLs 702 and to generate respective voltage feedback signals Vf(1) –Vf(n). The voltage feedback signals are provided to respective shorted lamp detectors shown as shorted lamp detectors 802(1)–802(n) (collectively referred to as the shorted lamp detectors 802). The shorted lamp detectors 802 provide respective outputs, DISABLE(1)–DISABLE(n), to indicate shorted lamp conditions for the respective CCFLs 702.

In one embodiment, the power conversion circuit employs Royer oscillator inverter architecture, and the DC blocking capacitors 806 are relatively small (e.g., approximately 10 picofarads). Shorted lamp conditions are reliably detected by sensing the voltages across each of the CCFLs 702.

Although described above in connection with CCFLs, it should be understood that a similar apparatus and method can be used to drive fluorescent lamps having filaments, neon lamps, and the like.

The presently disclosed embodiments are to be considered in all respect as illustrative and not restrictive. The scope of the invention being indicated by the append claims, rather than the foregoing description, and all changes which comes within the meaning and ranges of equivalency of the claims are therefore, intended to be embrace therein.

What is claimed is:

1. A power conversion circuit with shorted lamp detection for driving at least one fluorescent lamp, the circuit comprising:

an inverter configured to receive a substantially direct current input voltage and to generate an alternating current lamp voltage to drive the fluorescent lamps; and a shorted lamp detector configured to monitor the alternating current lamp voltage and to generate a feedback voltage with an amplitude proportional to the amplitude of the lame voltage, wherein the shorted lamp detector produces periodic pulses if the amplitude of the feedback voltage is above a predefined threshold to indicate normal operations and produces a substantially direct current voltage if the amplitude of the feedback voltage is below the predefined threshold to detect a shorted lamp condition.

2. The power conversion circuit of claim 1, wherein the inverter comprises:

a primary network configured to receive the substantially direct current input voltage;

a controller configured to output driving signals to the primary network to generate an alternating current signal in the primary network; and a secondary network coupled to the primary network and configured to output the alternating current lamp voltage.

3. The power conversion circuit of claim 2, wherein the controller is disabled when the shorted lamp condition lasts longer than a predetermined duration.

4. A power conversion circuit with shorted lame detection for driving at least one fluorescent lamp, the circuit comprising:

an inverter configured to receive a substantially direct current input voltage and to generate an alternating current lamp voltage to drive the fluorescent lamps, wherein the inverter comprises:

a primary network configured to receive the substantially direct current input voltage;

a controller configured to output driving signals to the primary network to generate an alternating current signal in the primary network; and a secondary network coupled to the primary network and configured to output the alternating current lamb voltage;

a shorted lamp detector configured to monitor the alternating current lamp voltage to detect a shorted lamp condition; and a voltage sensing feedback circuit coupled to the output of the secondary network to sense the alternating current lamp voltage and to generate a voltage feedback signal with an amplitude proportional to the amplitude of the alternating current lamp voltage for the shorted lamp detector.

5. The power conversion circuit of claim 4, wherein the voltage sensing feedback circuit is a capacitive voltage divider.

6. The power conversion-circuit of claim 4, wherein the voltage sensing feedback circuit is a resistive voltage divider.

7. The power conversion circuit of claim 4, wherein the shorted lamp detector comprises:

an open collector comparator coupled to the output of the voltage sensing feedback circuit;

a holding capacitor coupled to the output of the open collector comparator;

a pull-up resistor coupled to the output of the open collector comparator; and a reference comparator coupled to the output of the open collector comparator.

8. The power conversion circuit of claim 4, wherein the shorted lamp detector comprises:

a high voltage detector coupled to the output of the voltage sensing feedback circuit;

a conditioning circuit coupled to the output of the high voltage detector; and a threshold detector coupled to the output of the conditioning circuit.

9. The power conversion circuit of claim 8, wherein the high voltage detector is a single transistor amplifier.

10. The power conversion circuit of claim 8, wherein the conditioning circuit comprises:

a half-wave rectifier;

a timing resistor; and a charging capacitor.

11. The power conversion circuit of claim 8, wherein the threshold detector is a comparator.

12. A method for detecting a shorted lamp condition in a backlight system, the method comprising the acts of:

sensing a lamp voltage provided by an inverter to drive at least one fluorescent lamp in the backlight system;

generating a feedback voltage with an amplitude proportional to the amplitude of the lamp voltage;

generating periodic pulses if the amplitude of the feedback voltage is above a predefined threshold indicative of normal operations; and generating a substantially direct current voltage if the amplitude of the feedback voltage is below the predefined threshold indicative of the shorted lamp condition.

13. The method of claim 12 further comprising the act of disabling the inverter when the shorted lamp condition lasts longer than a predetermined duration.

* * * * *

UNITED STATES PATENT AND TRADEMARK OFFICE

CERTIFICATE OF CORRECTION

PATENT NO. : 6,870,330 B2
DATED : March 22, 2005
INVENTOR(S) : Hwangsoo Choi

It is certified that error appears in the above-identified patent and that said Letters Patent is hereby corrected as shown below:

Column 11,
Lines 11 and 32, delete “lame” and insert -- lamp --.
Line 45, delete “lamb” and insert -- lamp --.

Column 12,
Line 4, delete “conversion-circuit” and insert -- conversion circuit --.

Signed and Sealed this

Fifteenth Day of November, 2005

JON W. DUDAS
*Director of the United States Patent and Trademark Office*